US009518437B2

(12) United States Patent
Hallundbæk

(10) Patent No.: US 9,518,437 B2
(45) Date of Patent: Dec. 13, 2016

(54) MODULAR DOWNHOLE TOOL

(75) Inventor: Jørgen Hallundbæk, Græsted (DK)

(73) Assignee: WELLTEC A/S, Allerød (DK)

( * ) Notice: Subject to any disclaimer, the term of this patent is extended or adjusted under 35 U.S.C. 154(b) by 229 days.

(21) Appl. No.: 14/008,301

(22) PCT Filed: Mar. 29, 2012

(86) PCT No.: PCT/EP2012/055637
§ 371 (c)(1),
(2), (4) Date: Sep. 27, 2013

(87) PCT Pub. No.: WO2012/130939
PCT Pub. Date: Oct. 4, 2012

(65) Prior Publication Data

US 2014/0014315 A1 Jan. 16, 2014

(30) Foreign Application Priority Data

Mar. 30, 2011 (EP) ..... 11160493

(51) Int. Cl.
*E21B 23/14* (2006.01)
*E21B 23/04* (2006.01)
(Continued)

(52) U.S. Cl.
CPC ..... *E21B 23/04* (2013.01); *E21B 10/32* (2013.01); *E21B 17/1021* (2013.01);
(Continued)

(58) Field of Classification Search
CPC ..... E21B 2035/008; E21B 23/14; E21B 29/06
See application file for complete search history.

(56) References Cited

U.S. PATENT DOCUMENTS 3,177,938 A 4/1965 Rene
3,831,443 A * 8/1974 Planche ..... 73/152.54
(Continued)

FOREIGN PATENT DOCUMENTS

CN 201507258 U 6/2010
CN 201521289 U 7/2010
(Continued)

OTHER PUBLICATIONS

International Preliminary Report on Patentability issued in International Patent Application No. PCT/EP2012/055637 on Oct. 1, 2013.
(Continued)

*Primary Examiner* — David Andrews
*Assistant Examiner* — Michael Goodwin
(74) *Attorney, Agent, or Firm* — Nixon & Vanderhye P.C.

(57) ABSTRACT

The present invention relates to a downhole tool extending in a longitudinal direction, comprising a tool housing; an arm assembly pivotally mounted about a pivot point fixed in relation to the tool housing and movable between a retracted position and a projecting position in relation to the tool housing; an arm activation assembly for moving the arm assembly between the retracted position and the projecting position, the arm activation assembly being arranged inside the tool housing and having a first end face and a second end face adapted for being connected with the end faces of other arm activation assemblies; wherein the arm activation assembly comprises: a piston housing having a piston chamber extending in the longitudinal direction of the downhole tool and comprising: a first piston housing part, a second piston housing part removably connected to the first piston housing part, a piston member arranged inside the piston housing and connected with the arm assembly, the piston member being movable in the piston housing in the longitudinal direction of the downhole tool.

14 Claims, 9 Drawing Sheets

(51) Int. Cl.

| | |
|---|---|
| ***E21B 10/32*** | (2006.01) |
| ***E21B 17/10*** | (2006.01) |
| ***E21B 23/01*** | (2006.01) |
| ***E21B 29/06*** | (2006.01) |
| *E21B 23/00* | (2006.01) |

(52) U.S. Cl.
CPC ..... *E21B 23/01* (2013.01); *E21B 23/14* (2013.01); *E21B 29/06* (2013.01); *E21B 2023/008* (2013.01)

(56) References Cited

U.S. PATENT DOCUMENTS

| | | | | |
|---|---|---|---|---|
| 4,819,760 | A * | 4/1989 | Petermann | 181/102 |
| 6,273,189 | B1 | 8/2001 | Gissler et al. | |
| 6,629,568 | B2 | 10/2003 | Post et al. | |
| 2005/0217867 | A1 * | 10/2005 | Misselbrook | 166/384 |
| 2007/0089912 | A1 | 4/2007 | Eddison et al. | |
| 2007/0181298 | A1 | 8/2007 | Sheiretov et al. | |
| 2009/0025941 | A1 | 1/2009 | Iskander et al. | |
| 2009/0101362 | A1 | 4/2009 | Loughlin | |
| 2009/0223659 | A1 | 9/2009 | Hill et al. | |
| 2010/0012315 | A1 | 1/2010 | McInally | |
| 2012/0037358 | A1 | 2/2012 | Ferkingstad et al. | |

FOREIGN PATENT DOCUMENTS

| | | | |
|---|---|---|---|
| RU | 2 034 140 | C1 | 4/1995 |
| RU | 2 236 549 | C2 | 9/2004 |
| RU | 2 341 639 | C2 | 12/2008 |
| RU | 2 354 801 | C2 | 5/2009 |
| WO | WO 93/18277 | | 9/1993 |
| WO | WO 2006/115418 | | 11/2006 |
| WO | WO 2008/091157 | | 7/2008 |
| WO | WO 2008/111844 | | 9/2008 |
| WO | WO 2009/020397 | | 2/2009 |
| WO | WO 2009/111693 | | 9/2009 |
| WO | WO 2010/036236 | A1 | 4/2010 |
| WO | WO 2010/123375 | | 10/2010 |

OTHER PUBLICATIONS

International Search Report for PCT/EP2012/055637, mailed Jun. 15, 2012.
Written Opinion for PCT/EP2012/055637, mailed Jun. 15, 2012.
Sep. 2, 2015 Office Action issued in Chinese Patent Application No. 201280016337.0 (with English translation).
Jun. 1, 2016 Decision to Grant issued in Russian Application No. 2013147939/03(074546).

* cited by examiner

MODULAR DOWNHOLE TOOL

This application is the U.S. national phase of International Application No. PCT/EP2012/055637, filed 29 Mar. 2012, which designated the U.S. and claims priority to Europe Application No. 11160493.0, filed 30 Mar. 2011, the entire contents of each of which are hereby incorporated by reference.

FIELD OF THE INVENTION

The present invention relates to a downhole tool extending in a longitudinal direction, comprising a tool housing; an arm assembly movable between a retracted position and a projecting position in relation to the tool housing; an arm activation assembly for moving the arm assembly between the retracted position and the projecting position, the arm activation assembly having a first end face and a second end face. Furthermore, the invention relates to a downhole system comprising the downhole tool according to the invention and an operational tool.

BACKGROUND ART

Downhole tools are used for operations inside boreholes of oil and gas wells. Downhole tools operate in a very harsh environment and must be able to withstand inter alia corrosive fluids, very high temperatures and pressure.

To avoid unnecessary and expensive disturbances in the production of oil and gas, the tools deployed downhole have to be reliable and easy to remove from the well in case of a breakdown. Tools are often deployed at great depths several kilometers down the well, and removing jammed tools are therefore a costly and time-consuming operation.

Well tools are often part of a larger tool string containing tools with different functionalities. A tool string may comprise both transportation tools for transporting the tool string in the well and operational tools for performing various operations downhole.

Various principles for downhole transportation tools, also denoted well tractors, have been developed and tested. The transportation tools are primarily used for transporting tool strings in horizontal or close to horizontal parts of the well where gravity is insufficient for driving the tool string forward.

Downhole tools are complex mechanical constructions, often with multiple functionalities, yet they have to be reliable and capable of functioning in a harsh environment. These conditions set high standards for the applied mechanical design, including the sealing quality of joints and assemblies, manufacturing processes, tolerances and materials.

The above often results in complicated constructions having e.g. vulnerable internal hydraulic piping posing many potential leaks. Therefore, a need exists for downhole tools that are relatively easy and safe to assemble and subsequently take apart during e.g. maintenance or overhaul.

SUMMARY OF THE INVENTION

It is an object of the present invention to wholly or partly overcome the above disadvantages and drawbacks of the prior art. More specifically, it is an object to provide an improved downhole tool wherein the number of components is as low as possible to reduce the need for creating joints and wherein the tool may be assembled from modules without the need for special equipment or tools.

The above objects, together with numerous other objects, advantages, and features, which will become evident from the below description, are accomplished by a solution in accordance with the present invention by a downhole tool extending in a longitudinal direction, comprising: a tool housing; an arm assembly pivotally mounted about a pivot point fixed in relation to the tool housing and movable between a retracted position and a projecting position in relation to the tool housing; and an arm activation assembly for moving the arm assembly between the retracted position and the projecting position, the arm activation assembly being arranged inside the tool housing and having a first end face and a second end face adapted for being connected with the end faces of other arm activation assemblies; wherein the arm activation assembly comprises: a piston housing having a piston chamber extending in the longitudinal direction of the downhole tool and comprising: a first piston housing part, a second piston housing part removably connected to the first piston housing part, and a piston member arranged inside the piston housing and connected with the arm assembly, the piston member being movable in the piston housing in the longitudinal direction of the downhole tool.

In one embodiment, the downhole tool extending in a longitudinal direction may comprise: a tool housing; an arm assembly movable between a retracted position and a projecting position in relation to the tool housing; an arm activation assembly for moving the arm assembly between the retracted position and the projecting position, the arm activation assembly having a first end face and a second end face; wherein the arm activation assembly comprises: a piston housing having a piston chamber extending in the longitudinal direction of the downhole tool and comprising: a first piston housing part, a second piston housing part removably connected to the first piston housing part, a piston member arranged inside the piston housing and connected with the arm assembly, the piston member being movable in the piston housing in the longitudinal direction of the downhole tool.

Hereby, a modular construction is achieved wherein preassembled modules may be arranged and joined in a tool housing, creating an easy and safe assembly and dismantle process when performing necessary service on the tool. Such service may be performed between two runs and at the rig or vessel, and thus special safety equipment may not be present at such service work. By the present downhole tool comprising a two-part piston housing and preassembled modules, service can be done without any such special equipment.

The downhole tool according to the invention may comprise at least two arm assemblies and at least two activation assemblies.

Combining several modules in the same housing provides a simple solution to mount and dismantle the downhole tool at the rig or vessel. Furthermore, it provides a scalable downhole tool that can be tailored to the specific characteristics of the given downhole operation and thus having as many arm assemblies as required for a specific operation.

In one embodiment, the two arm assemblies may project in opposite directions from the housing.

By the arm assemblies projecting in opposite directions, the downhole tool is centralised inside the well bore or casing.

Moreover, the piston housing may comprise one or more through-going fluid channels in one or more walls of the first and/or second piston housing parts.

Hereby, the fluid channels are well protected by the solid material of the piston housing, providing a robust and reliable hydraulic system. Furthermore, no extra piping is needed in order to transport fluid from a pump to an adjacent arm activation assembly.

Also, the arm activation assembly may further comprise a spring member arranged in the piston housing, the spring member acting on the piston member to push the piston member in a first direction.

Hereby, an arm activation assembly is created wherein the spring can be inserted into the piston housing whereupon the piston housing is sealed off by the second piston housing part being connected to the first piston housing part. While connecting the first and the second piston housing parts, the spring member can be preloaded to be capable of forcing the piston in the opposite direction than the direction in which the hydraulic fluid moves the piston member. A two-part housing enclosing the spring member creates a safe and reliable construction wherein the spring is restrained and kept under control, also during service work.

Further, the piston member may comprise a first and a second piston face, wherein the spring member acts on the second face to push the piston member in a first direction and a fluid acts on the first piston face to push the piston in a second direction opposite to the first direction.

Said spring member may be preloaded.

The spring member may be a coiled spring, a gas piston or other resilient member capable of exerting a force on a surface when it has been compressed.

In addition, the spring member may be arranged inside a piston chamber in the piston housing, the piston chamber having a first end face and a second end face, and wherein the distance between the second piston face and the first end face of the piston chamber is less than a length of the spring member in a relaxed condition.

The one or more fluid channels in one arm activation assembly may be adapted for being connected with one or more fluid channels in another arm activation assembly by insertion of connectors creating a fluid-tight connection.

Hereby, a scalable system is provided wherein the hydraulic circuit is constantly modified to fit the number of modules used.

In one embodiment, two or more arm activation assemblies may be arranged in succession of each other in the longitudinal direction so that the second end face of a first activation assembly abuts the first end face of a second and subsequent arm activation assembly.

When viewed from an end of the downhole tool in the longitudinal direction, each piston member may have a cross-sectional area, and the transversal distribution of the cross-sectional area of two successive piston members may overlap when viewed from an end of the downhole tool in the longitudinal direction.

By having the piston members arranged with overlapping cross-sectional areas, the size of the cross-sectional area of the piston members can be increased to fill up more of the available space inside the tool housing, i.e. the size of the piston face can be increased, and hereby the force exerted by the piston member increases.

The tool housing of the downhole tool according to the invention may comprise: a first tool housing part, and an activation unit removably connected with the first tool housing part, the activation unit comprising: a second tool housing part, and a closing member removably connected with the second tool housing part, wherein the second tool housing part and the closing member together constitute a fluid-tight chamber wherein the two or more arm activation assemblies are arranged.

The tool housing may further comprise a sealing member arranged between the second tool housing part and the closing member.

Further, each of the arm assemblies may pivot about an arm rotation axis, the arm rotation axis being offset from a centre axis of the downhole tool and being perpendicular to a plane comprising the centre axis.

Additionally, the arm rotation axes of two successive arm assemblies may be offset in opposite directions in relation to the centre axis of the downhole tool.

Also, the piston member may be connected with the arm assembly using a worm shaft or a rack or a pivot joint or a recess in the piston member.

The piston member may comprise a worm shaft or a rack or a pivot joint or a recess.

Moreover, each of the arm assemblies may comprise a wheel or an anchor device or a casing penetration means or a centraliser.

Furthermore, the arm activation assembly may comprise a crank connecting the piston member with the arm assembly.

The crank may comprise a crank arm and a crank shaft, the crank arm being connected with the piston member by the crank arm extending into the recess in the piston member and the crank shaft being connected with the arm assembly by comprising a geometry adapted to engage with a geometry of the arm assembly.

The present invention further relates to a downhole system comprising the downhole tool according to the invention and an operational tool connected with the downhole tool for being moved forward in a well or borehole.

The operational tool may be a stroker tool, a key tool, a milling tool, a drilling tool, a logging tool, etc.

BRIEF DESCRIPTION OF THE DRAWINGS

The invention and its many advantages will be described in more detail below with reference to the accompanying schematic drawings, which for the purpose of illustration show some non-limiting embodiments and in which.

All the figures are highly schematic and not necessarily to scale, and they show only those parts which are necessary in order to elucidate the invention, other parts being omitted or merely suggested.

DETAILED DESCRIPTION OF THE INVENTION

Figure 1:
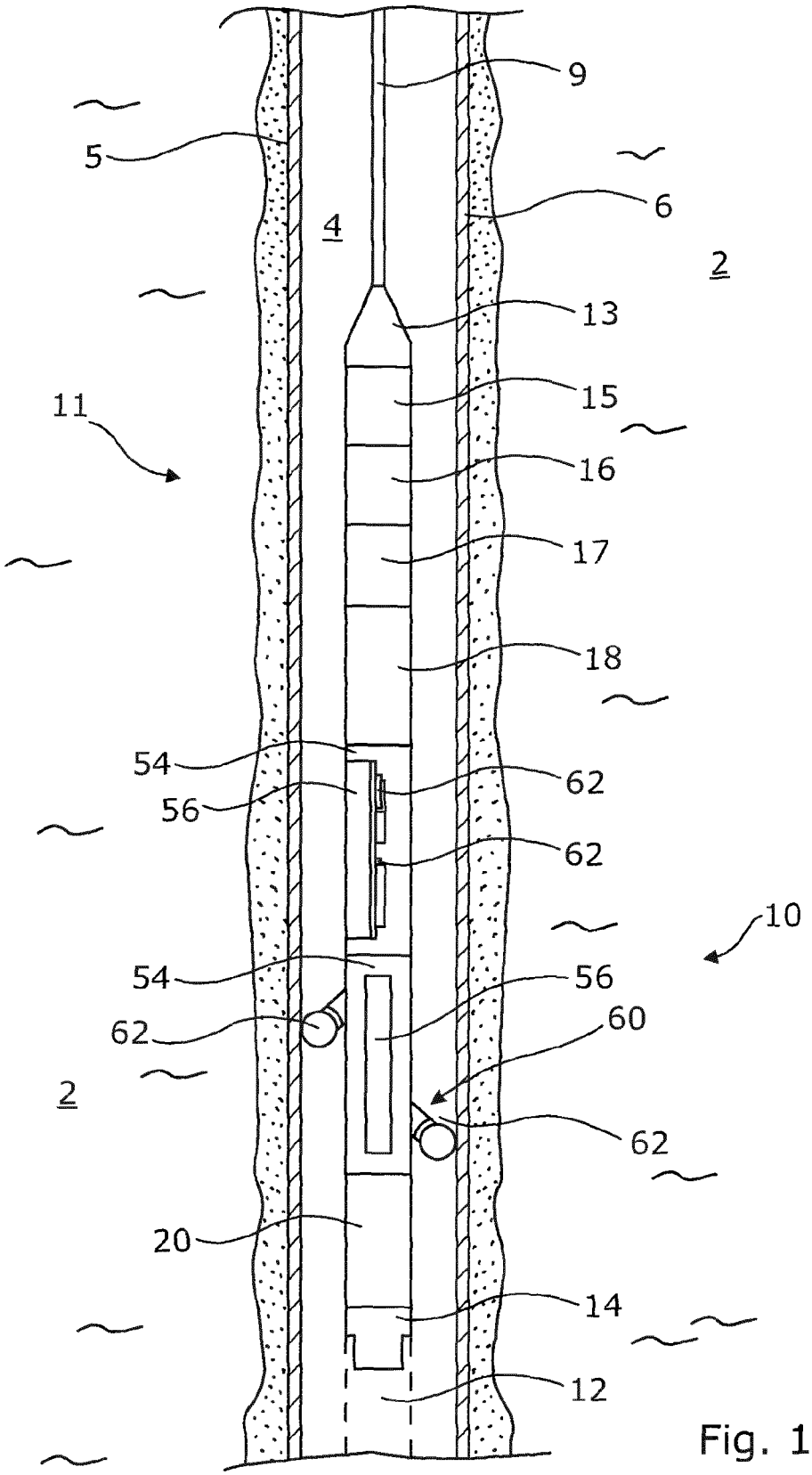
FIG. 1 shows a tool string comprising a driving unit downhole.

FIG. 1 shows a tool string 10 comprising a downhole tool 11 suspended in a well bore or cased well. The downhole tool comprises several arm assemblies 60 projecting from the downhole tool towards the casing or side walls of the well. The arm assemblies 60 can be moved between a retracted position and a projecting position. The arm assemblies may have several different functionalities and could accommodate wheels, anchor elements, centraliser devices or other devices required to be able to move between a retracted position and an extending or projecting position. Thus, the downhole tool 11 may have several different functionalities according to the configuration of the arm assemblies 60. The downhole tool 11 may be used as a transportation tool wherein projecting wheels rotate to drive forward the downhole tool or tool string. The downhole tool 11 may also be used as an anchoring tool for fixating the tool string in the well or as a centraliser device for positioning the tool string in the well bore or casing.

Figure 2:
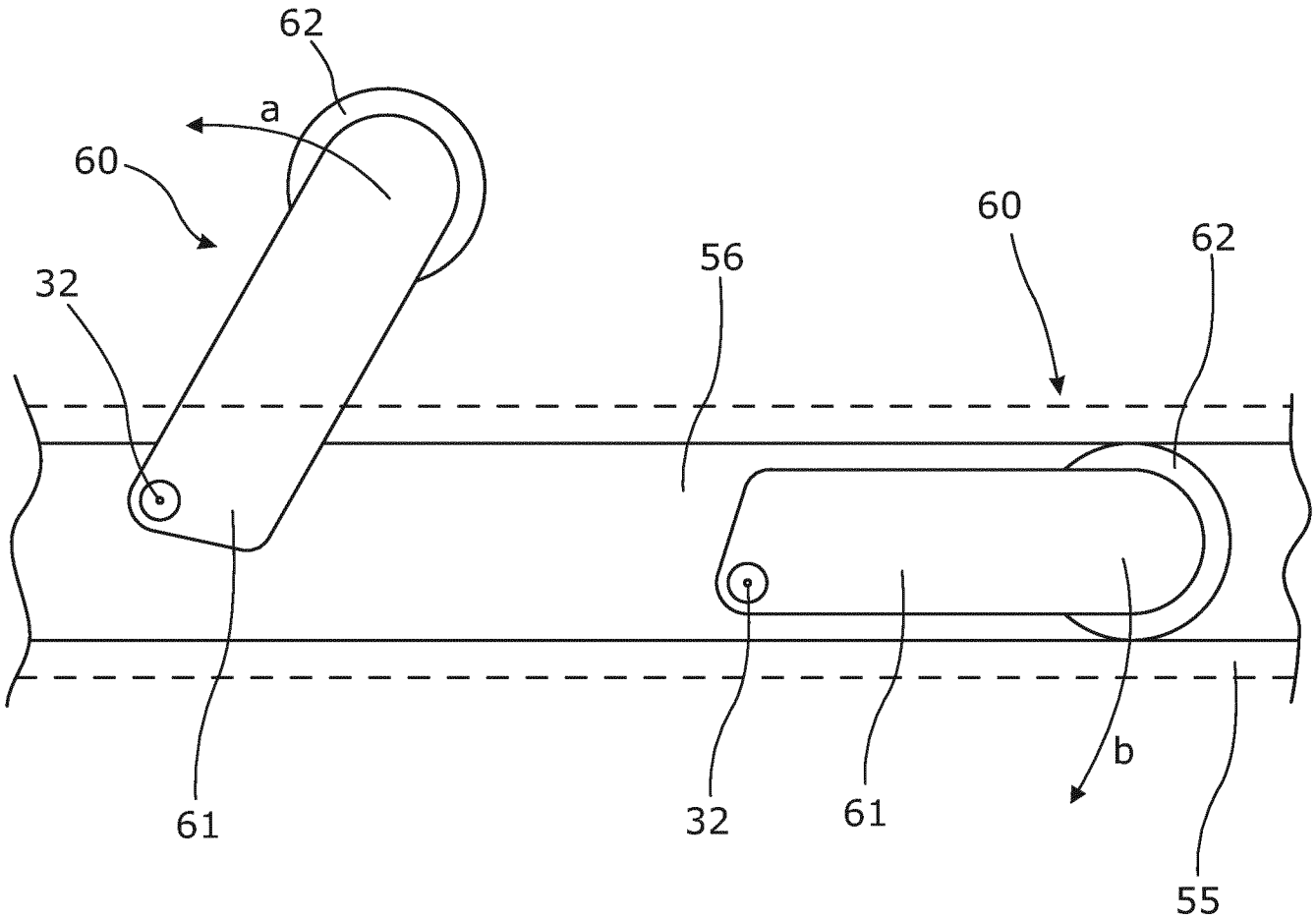
FIG. 2 shows, for illustrative purposes, a top view of part of a downhole tool with one arm assembly in a projecting position and another arm assembly in a retracted position.
Figure 4:
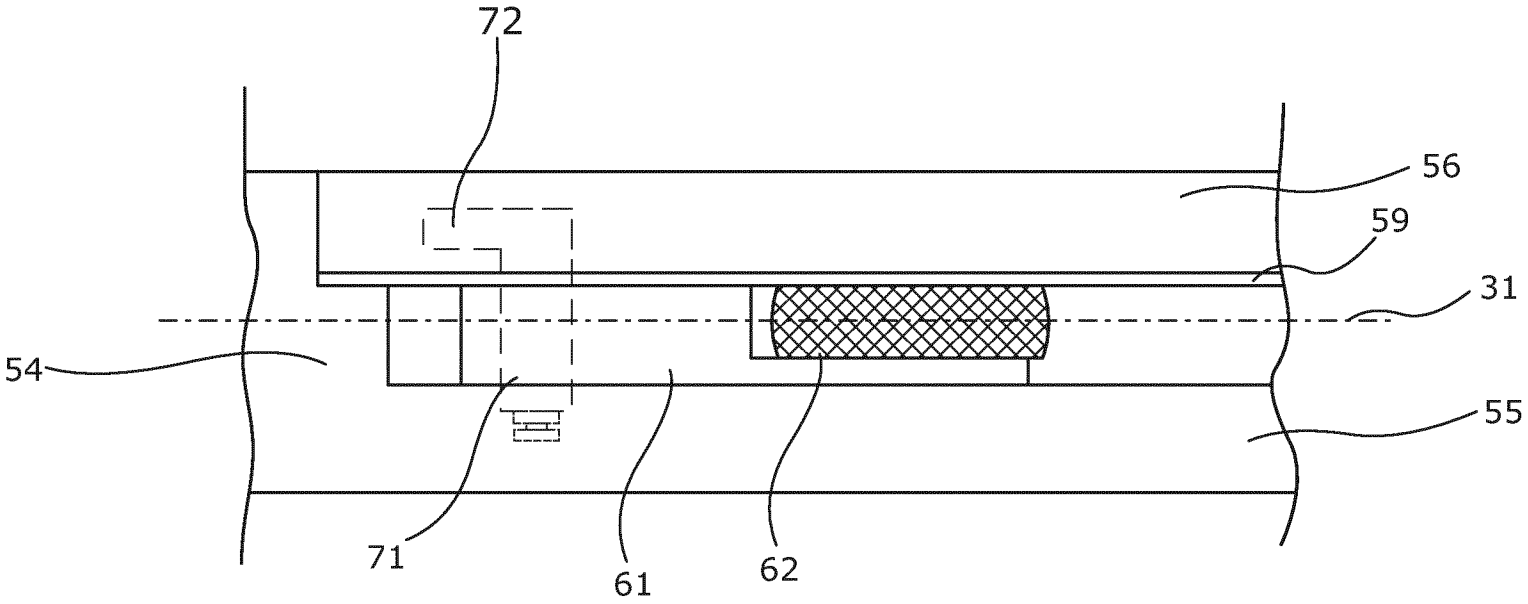
FIG. 4 shows a side view of part of a downhole tool with an arm assembly in a retracted position.

The downhole tool 11 extends in a longitudinal direction and comprises one or more tool housings 54 arranged end to end with their respective end faces connected with each other. The downhole tool 11 further comprises multiple arm assemblies 60 and multiple arm activation assemblies 40. In FIG. 2, two arm assemblies 60 are shown in the projecting position and the retracted position, respectively, for illustrative purposes as the arm assemblies in a downhole tool according to the invention usually move in a synchronised manner wherein all the arm assemblies are either retracted or projecting at the same time. In the retracted position, the arm assembles 60 are substantially encased by the tool housing 54, as shown in FIG. 4.

Figure 3:
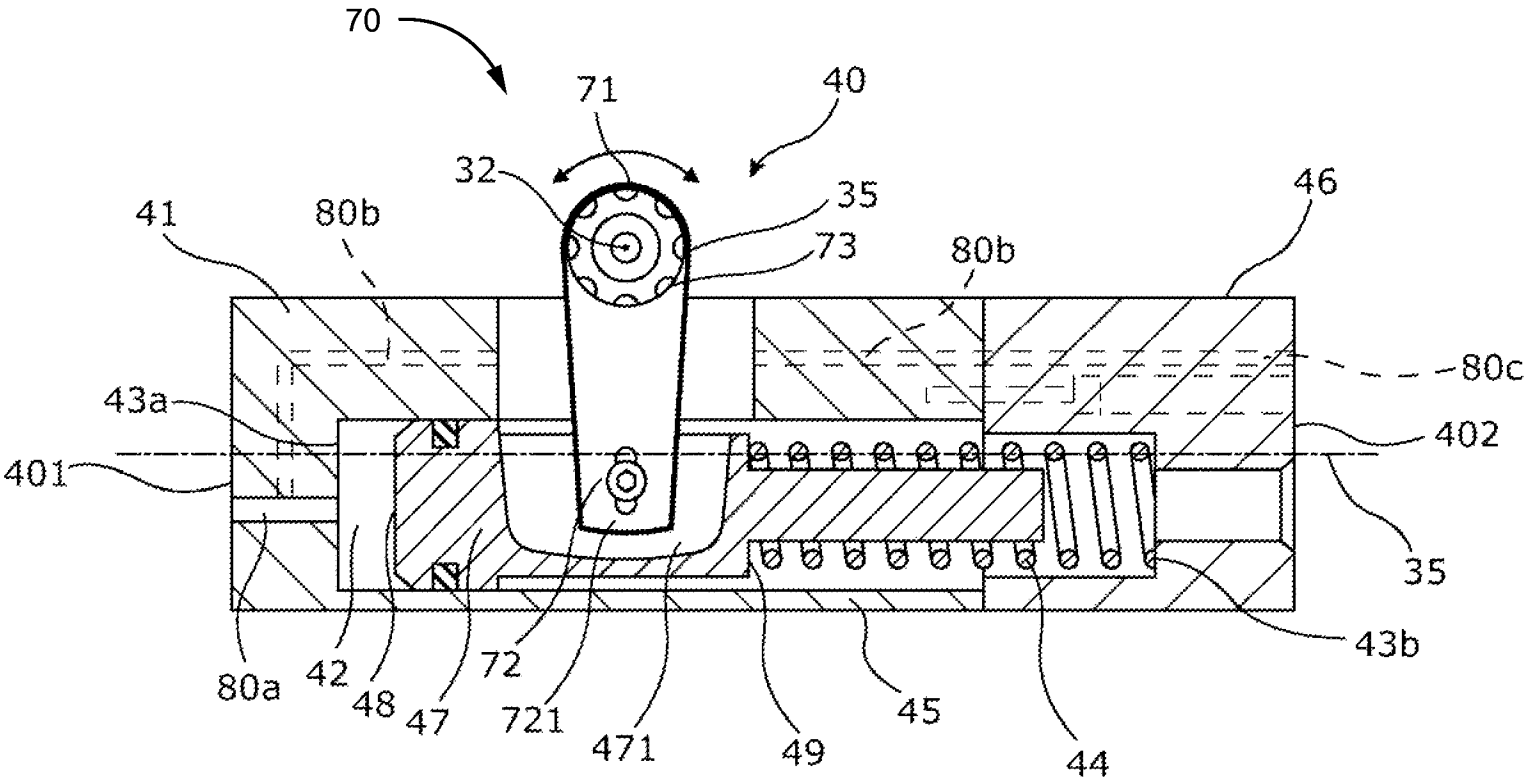
FIG. 3 shows a cross-sectional view of an arm activation assembly.

FIG. 3 shows the arm activation assembly 40 for moving the arm assembly 60 between the retracted position and the projecting position. The arm activation assembly 40 is arranged in the tool housing 54 of the downhole tool 11 being part of the tool string 10. The arm activation assembly 40 has a first end face 401 and a second end face 402 adapted for being connected with the end faces of other arm activation assemblies. The arm activation assembly 40 comprises a piston housing 41 having a piston chamber 42 extending in the longitudinal direction of the downhole tool 11. The piston housing 41 is divided into a first piston housing part 45 and a second piston housing part 46. The first and the second piston housing parts are removably connected by means of e.g. a bolt extending from the second end face 402 through the second piston housing part 46 and into a threaded connection with the first piston housing part 45. The piston chamber 42 of the piston housing 41 extends in the longitudinal direction into both piston housing parts. The first piston housing part 45 defines a first end face 43*a* of the piston chamber 42, and the second piston housing part 46 defines a second end face 43*b* of the piston chamber 42. Inside the piston housing 41, a piston member 47 is arranged which is movable in the longitudinal direction of the downhole tool 11. The piston member 47 is connected with the arm assembly 60 and facilitates the movement of arm assembly back and forth between the retracted position and the projecting position. The piston member 47 is moved in a first direction towards the second end face 43*b* by a fluid acting on a first piston surface 48. The fluid is supplied to a part of the piston chamber 42 in front of the piston member 47 via fluid channel 80*a*, as will be described in more detail below.

The arm activation assembly 40 further comprises a spring member 44 arranged inside the piston housing 41 and acting to push the piston member 47 in a second direction opposite the first direction towards the first end face 43*a* of the piston chamber 42. When the piston member 47 and the spring member 44 are arranged in the piston chamber 42 inside the piston housing 41 and the first and second piston housing parts 45, 46 are connected, the spring member 44 is slightly preloaded to maintain the position of the piston in the piston chamber 42. In the design shown, the spring member 44 is a coiled spring. It is obvious to the person skilled that the coiled spring may be replaced by e.g. a gas piston or other resilient member capable of exerting a force on a surface when it has been compressed.

A fluid channel 80*a* is provided in the walls of the first piston housing part 45 for supplying a fluid, such as a hydraulic liquid, into the piston chamber 42. The fluid channel 80*a* extends from the first end face 401 of the arm activation assembly 40 and into the piston chamber 42. An additional fluid channel 80*b* is provided in the walls of the first piston housing part 45 for supplying fluid to other possible subsequent arm activation assemblies. The fluid channel 80*b* is connected with the fluid channel 80*a* whereby a common inlet may be provided in the first end face 401 for both fluid channels. In an alternative design, the fluid channels 80*a*, 80*b* may, however, have separate inlets in the first end face. The fluid channel 80*b* extends from the fluid channel 80*b* to a fluid channel 80*c* provided in the wall of the second piston housing part 46. The fluid channel 80*b* of the first piston housing part 45 and the fluid channel 80*c* of the second piston housing part 46 may be connected using a connection sleeve for providing a fluid-tight connection. The fluid channel 80*c* extends from one end of the second piston housing part 46 to the second end face 402 of the arm activation assembly 40. Part of the fluid entering the fluid channel 80*a* is diverted into the fluid channel 80*b* and transferred through the first piston housing part 45 and into the fluid channel 80*c* in the wall of the second piston housing part 46. From the fluid channel 80*c*, the fluid is transferred to the fluid channel of a possible subsequent piston housing.

The arm activation assembly 40 thus comprises an integrated fluid circuit in the form of fluid channels provided in the walls of the piston housing 41. Several activation assemblies may be combined to provide a larger fluid circuit without the need for external piping connecting the individual activation assemblies. Fluid channels of successive piston houses are joined by connectors (not shown) creating fluid-tight joints.

As shown in FIG. 3, the activation assembly further comprises a crank 70 constituted by a crank arm 72 and a crank shaft 71. The crank 70 connects the piston member 47 with the arm assembly 60 converting a transverse motion to a rotation force. In an alternative design of the downhole tool, the arm assembly 60 may be directly connected with the piston member 47, i.e. the arm assembly and the piston move in the same plane. As shown in the drawings, the crank arm 72 is connected with the piston member 47 by the crank arm being arranged in a recess in the piston member. The crank arm 72 may, however, be connected to the piston member 47 in any suitable way known to the person skilled, such as by using a rack also known as a toothed rack or gear-rack, or a worm shaft or a sliding pivot joint.

When the piston reciprocates, the crank arm 72 follows the piston member 47 and forces the crank shaft 71 to rotate in a defined angular interval. When the fluid pressure in the piston chamber 42 supersedes, the force of the spring member 44, the piston member 47 and hence a free end of the crank arm 72 move towards the second end face of the arm activation assembly 40. This in turn forces the crank shaft to rotate counter clockwise.

The crank shaft 71 is connected to an arm member 61 of the arm assembly 60. In the shown design, the crank shaft 71 comprises a toothed crank shaft pattern 73 mating with a similar pattern (not shown) in a bore in the arm member. The crank shaft 71 and the arm member hereby interlock whereby the rotation force is transferred from the crank shaft 71 to the arm member 61. In the shown design, the arm assembly 60 moves from the retracted position towards the projecting position when the piston moves towards the second end face 402 of the arm activation assembly 40. Conversely, the arm assembly 60 moves towards the retracted position when the piston is pushed by the spring towards the first end surface of the arm activation assembly 40.

Figure 5:
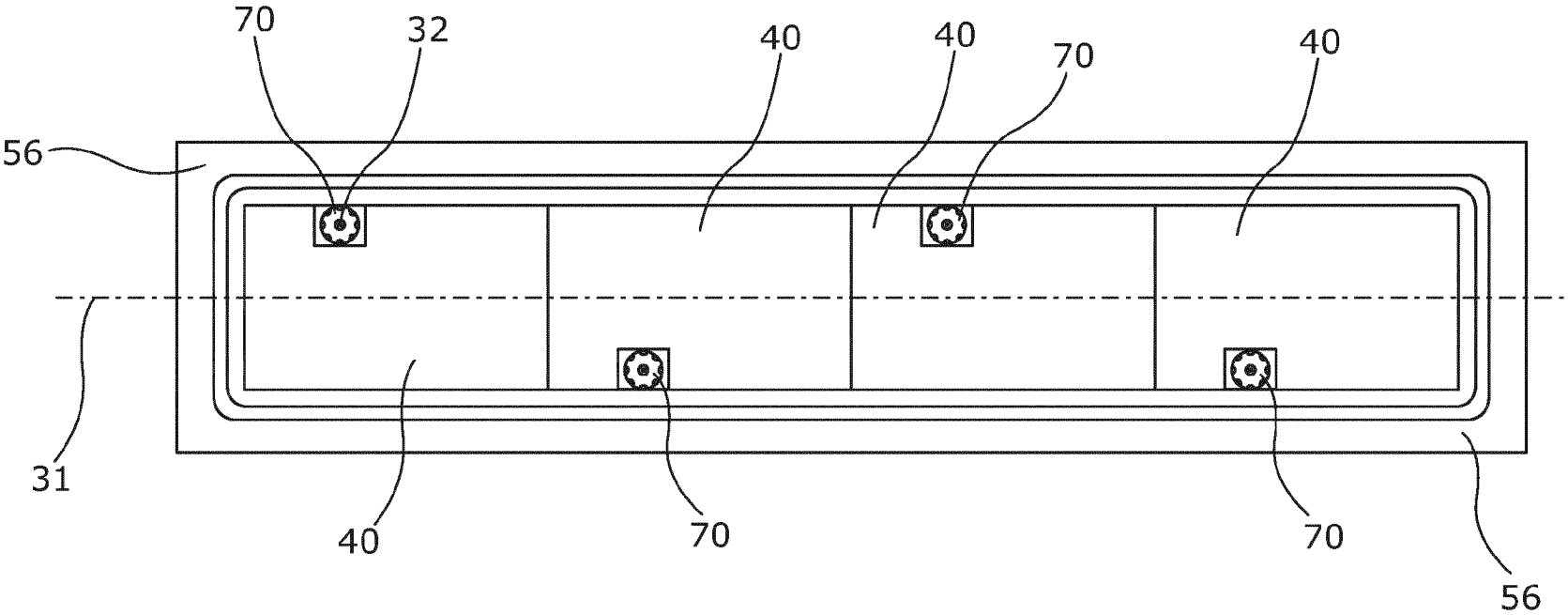
FIG. 5 shows a tool housing part.
Figure 6:
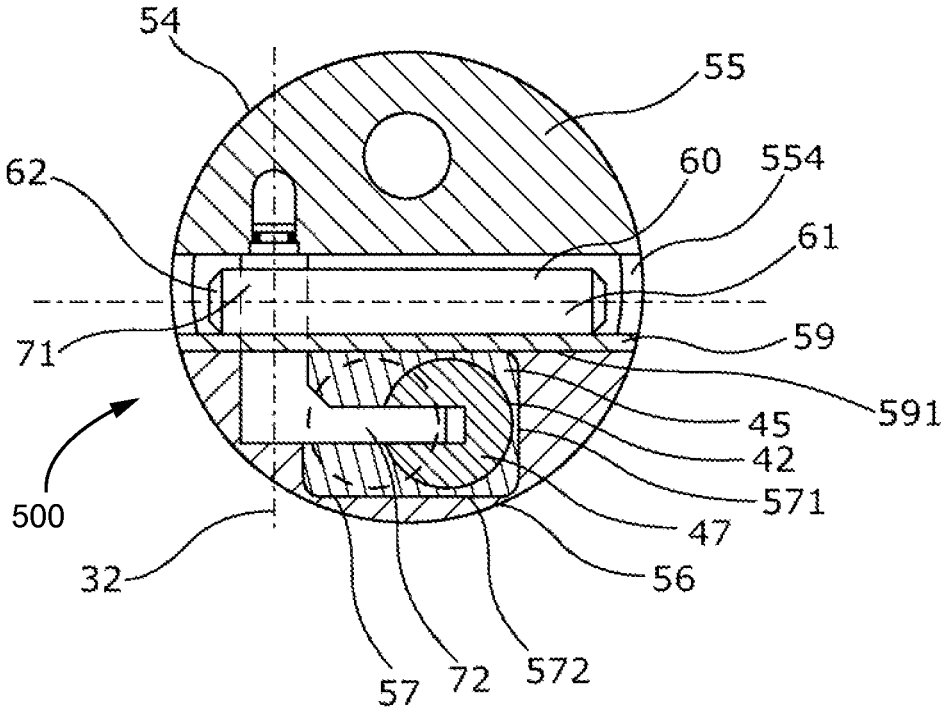
FIG. 6 shows a cross-sectional view of a downhole tool across the longitudinal direction.

As shown in FIG. 6, the tool housing 54 of the downhole tool 11 comprises a first tool housing part 55 and an activation unit 500 removably connected with the first tool housing part 55. The activation unit comprises a second tool housing part 56 and a closing member 59 removably connected with the side of second tool housing part 56. The second tool housing part 56 and the closing member 59 together constitute a fluid-tight chamber by the second tool housing part 56 comprising a cavity 57. In the shown design, the closing member is a plate-shaped element but it may be of any suitable geometry for creating a fluid-tight chamber along with the second tool housing part 56. Four arm activation assemblies 40 each moving an arm assembly 60 through the crank arm 72 are arranged in the fluid-tight chamber/cavity as shown in FIG. 5. The cavity has a geometry which substantially corresponds to the geometry of the arm activation assemblies 40, and the piston housings of the arm activation assemblies 40 are supported by a bottom surface 572 of the cavity 57.

When arranged in the second tool housing part 56, the arm activation assemblies 40 are positioned in succession of each other in the longitudinal direction so that the second end face of a previous activation assembly abuts the first end face of a subsequent arm activation assembly. Hereby, the fluid channels of successive piston housings may inter alia be interconnected as described earlier. The piston chamber 42 and hence the piston in each of the arm activation assemblies 40 are arranged offset from a centre axis 35 of the piston housing 41. This creates sufficient space for the drilling of the integrated fluid channels 80*b*, 80*c*. When the arm activation assemblies 40 are arranged in succession of each other, the offset position of the piston creates a system wherein cross-sectional areas of two successive pistons overlap each other when viewed from an end of the downhole tool as shown in FIG. 6. The dotted circular line in FIG. 6 indicates the piston member in the subsequent arm activation assembly, thereby showing the cross-sectional overlap between two pistons. In other words, the transverse distribution of one piston is not completely aligned with the transverse distribution of a neighbouring piston as would have been the case if the pistons where aligned on the same axis.

Figure 7:
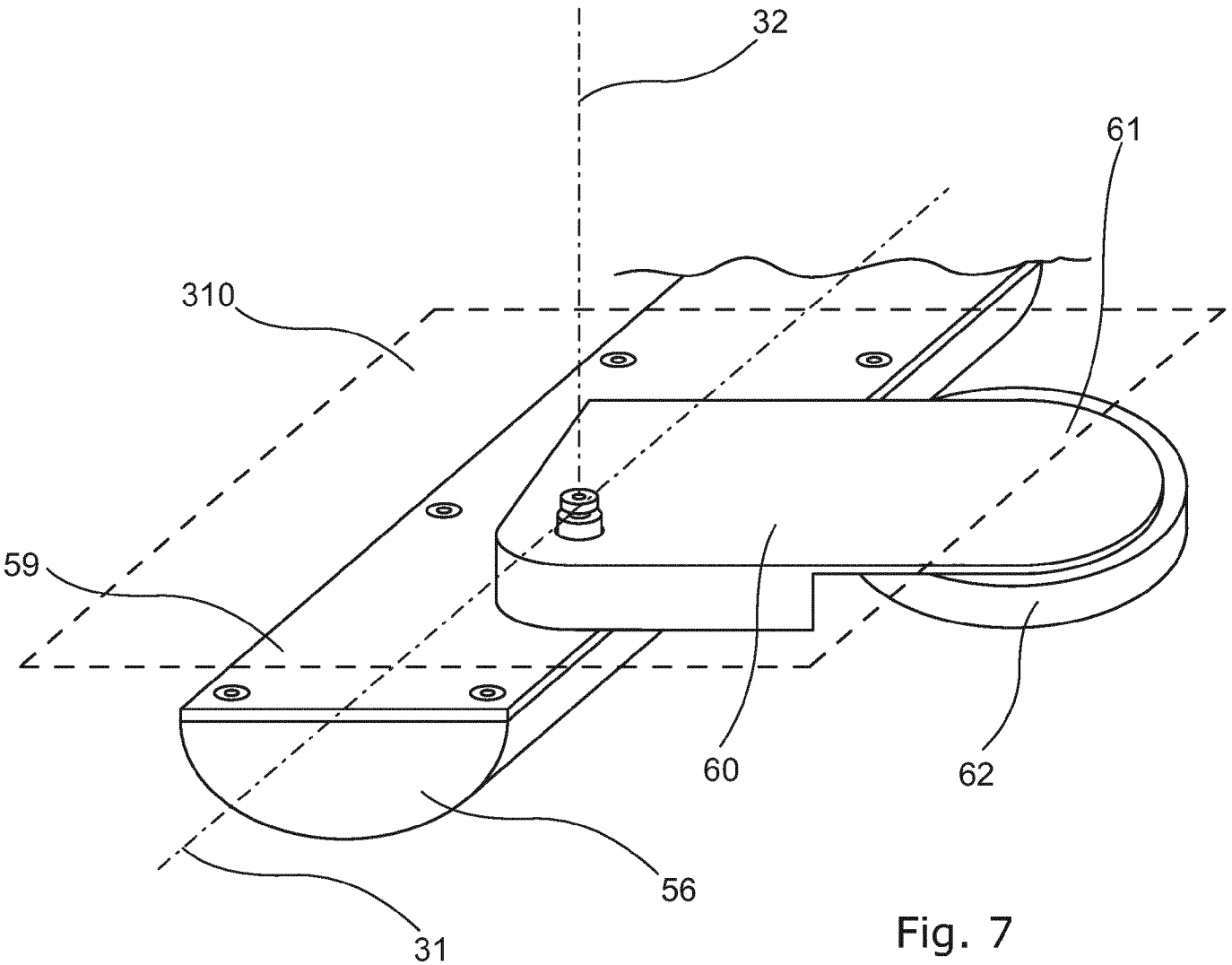
FIG. 7 shows a tool housing part with an arm assembly in a projected position.

As shown in FIG. 7, when the arm activation assemblies 40 are arranged in the tool housing and the closing member 59 is mounted on the plane side of the second tool housing part 56, the crank shafts 71 of the arm activation assemblies 40 extend through the closing member 59 perpendicularly to a surface thereof. The extension of the crank shaft 71 of each arm activation assembly 40 defines an arm rotation axis 32 which is perpendicular to both the closing member 59 and a plane 310 comprising the centre axis 31 of the downhole tool. Further, the arm rotation axes are offset from the centre axis 31 of the downhole tool 11 when seen in a direction perpendicular to the plane 310, e.g. as shown in FIG. 5. The arm activation assemblies 40 are arranged so that the crank shaft 71 of two successive arm assemblies 60 are positioned on opposite sides of the centre axis 31. Thereby the arm rotation axes of two successive arm assemblies 60 are offset in opposite directions in relation to the centre axis 31. With the alternating positions of the arm rotation axes as described above, the rotation axes of two successive arm assemblies 40 are not aligned when viewed in the longitudinal direction of the downhole tool.

As indicated by the arrows a, b in FIG. 2, the shown arm assemblies 60 project in opposite directions from the housing. In general, the downhole tool 11 is designed so that two successive arm assemblies project in opposite directions. By the arm assemblies having offset rotation axes, the possible range of the arm members to project from the tool housing is increased compared to a design utilising arm rotation axes aligned on a centre axis of the downhole tool. Further, the arm assemblies 60 are arranged in the centre of the tool housing 54 when viewed from the side parallel to the plane 310, as shown in FIG. 4.

By the downhole tool 11 comprising a multiplicity of projecting arm assemblies 60, each arm assembly or group of arm assemblies may be arranged to project in different projection planes like the plane 310 shown in FIG. 7. As indicated in FIG. 1, two separate groups of arm assemblies project in different planes being perpendicular to each other. As one downhole tool may comprise four groups of arm assemblies, each group may be arranged to project in a plane different from the others, e.g. each plane being displaced 45 degrees relative to the preceding plane.

Figure 8A:
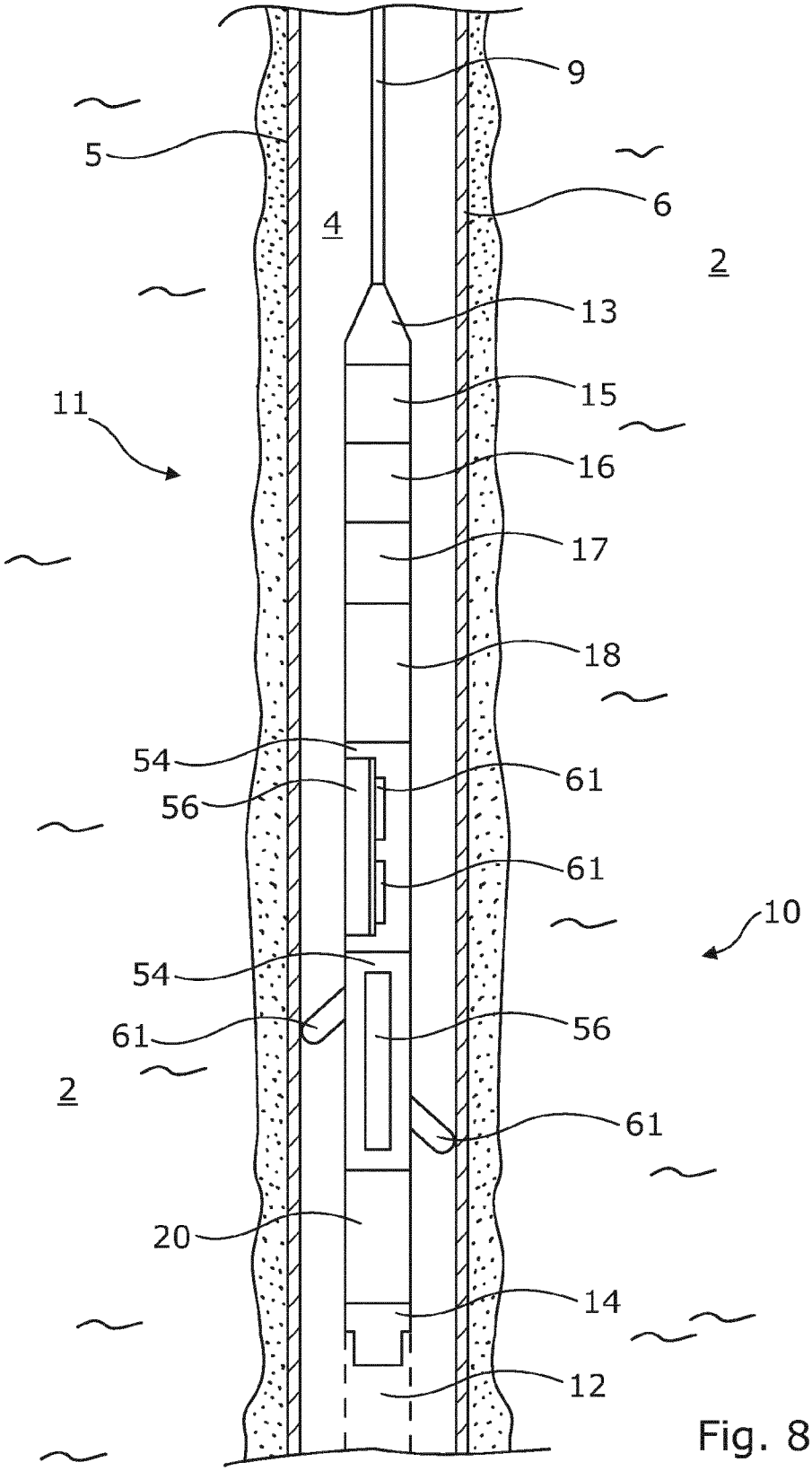
FIGS. 8*a* and 8*b* show downhole tools with different arm assemblies.
Figure 8B:
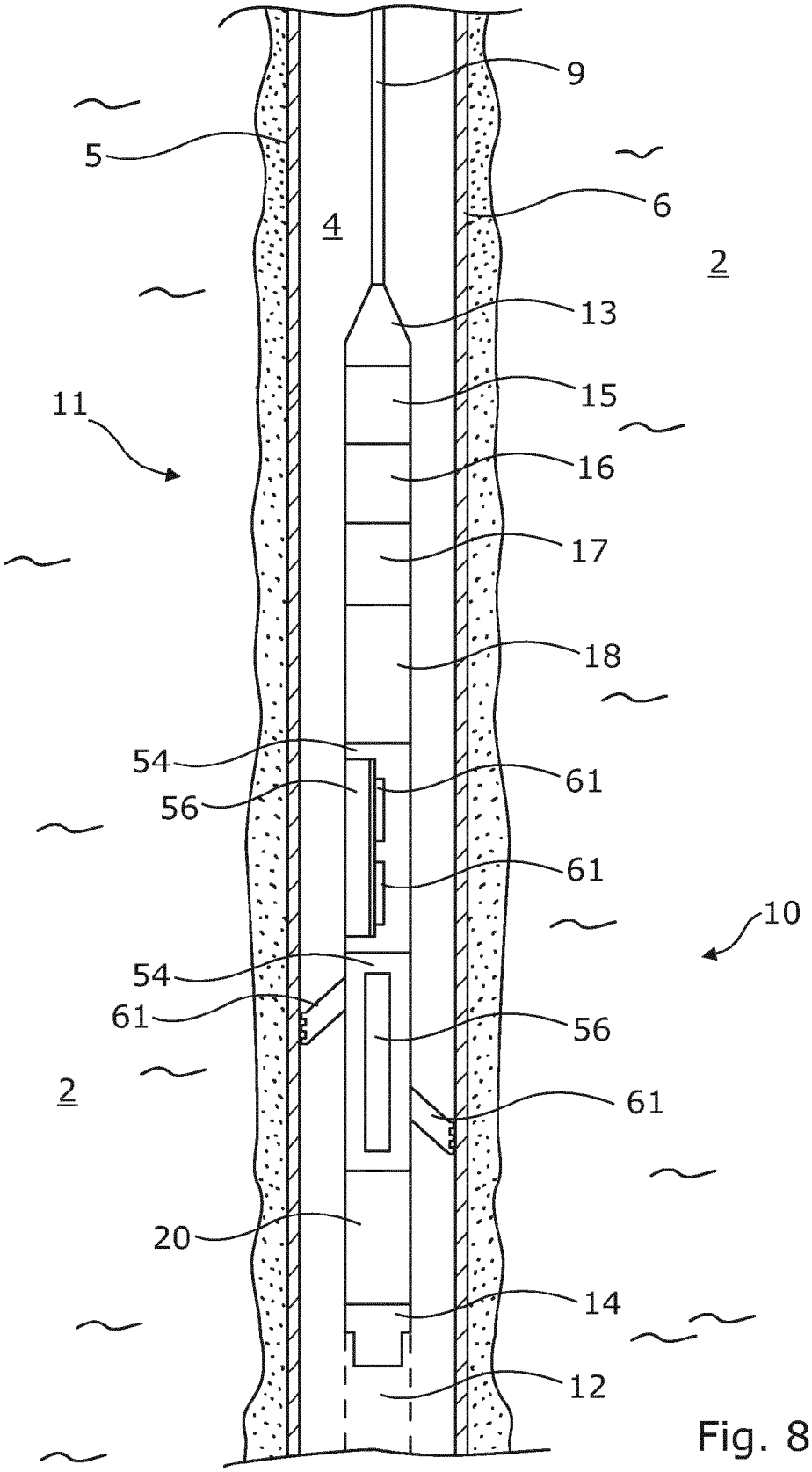

In FIGS. 1, 8*a* and 8*b*, the shown downhole tools comprise arm assemblies 60 having various configurations. FIG. 1 shows the downhole tool 11 embodied as a driving unit. In FIG. 8*a*, the arm assemblies 60 have no wheels, but instead the arm member 61 is designed with a curved free end which may be utilised when the arm assembly is part of a centraliser device. In FIG. 5*b* the free end of the arm member is equipped with teeth of serrations which may be used in an anchor device.

As shown, the downhole tool is suspended from and powered through a wireline 9 which is connected with the tool through a top connector 13. The downhole tool 11 further comprises an electronic section having modeshift electronics 15 and control electronics 16 for controlling the electricity supply before it is directed to an electrical motor 17 driving a hydraulic pump 18. The downhole tool 11 may be connected to one or more operational downhole tools 12, thereby constituting a tool string 10. Such operational tools could be a stroker tool providing an axial force in one or more strokes, a key tool opening or closing valves in the well, positioning tools such as a casing collar locator (CCL), a milling tool, a drilling tool, etc.

During assembly of the downhole tool, the multiplicity of arm activation assemblies 40 are arranged in the cavity of the second tool housing part 56. Prior to this, each piston housing 41 has been assembled by inserting the piston member 47 and the spring member 44 into the piston chamber 42, whereupon the piston housing 41 is closed by mounting the second piston housing part 46 on the first piston housing part 45. This assembly process might require the spring member to be slightly compressed, and a fixation tool is therefore sometimes required. After the piston housing 41 has been closed, the spring is secured inside and the piston housing, i.e. the arm activation assembly, can be handled safely without concern for the potential forces of the compressed spring member. The arm activation assembly 40 may thus be handled as a module or building block for assembling a downhole tool 11 according to the required specifications. The multiplicity of arm activation assemblies 40 in the cavity are arranged with the second end face 402 of a first arm activation assembly connected with the first end face 401 of a successive arm activation assembly and the integrated fluid channels are fluidly connected to provide a hydraulic circuit. When hydraulic fluid is supplied to the fluid channels of the first arm activation assembly, the hydraulic fluid is automatically supplied to the subsequent arm activation assemblies. Thus, arranging the arm activation assemblies in the cavity simultaneously completes the hydraulic circuit supplying hydraulic fluid to move the piston members inside the arm activation assemblies 60.

If an arm activation assembly 40, contrary to expectations, is malfunctioning, the structure of the downhole tool 11 makes it easy to replace the defect arm activation assembly. When the replacement or repaired arm activation assembly has been arranged in the cavity and connected with the other arm activation assemblies, it is by design connected to the hydraulic circuit. There is no need for connection of hydraulic hoses, packing of pipes, soldering, etc., to restore the hydraulic circuit.

Although the invention has been described in the above in connection with preferred embodiments of the invention, it will be evident for a person skilled in the art that several modifications are conceivable without departing from the invention as defined by the following claims.

The invention claimed is:

1. A downhole tool extending in a longitudinal direction, comprising:

a tool housing;

a first arm assembly pivotally mounted about a first pivot point fixed in relation to the tool housing and movable between a retracted state and a projecting state in relation to the tool housing; and a first arm activation assembly configured to move the first arm assembly between the retracted state and the projecting state, the first arm activation assembly being arranged inside the tool housing and having a first end face and a second end face, the first arm activation assembly comprising:

a first piston housing comprising a first piston housing part and a second piston housing part, the second piston housing part being removably connected to the first piston housing part to define a first piston chamber extending in the longitudinal direction of the downhole tool, a first piston member arranged at least partly within the first piston chamber and connected with the first arm assembly, the first piston member being movable in the first piston housing in the longitudinal direction of the downhole tool, and a first through-going fluid channel in the first and second piston housing parts;

a second arm assembly pivotally mounted about a second pivot point fixed in relation to the tool housing and movable between the retracted state and the projecting state in relation to the tool housing; and a second arm activation assembly configured to move the second arm assembly between the retracted state and the projecting state, the second arm activation assembly being arranged inside the tool housing and having a third end face and a fourth end face, the second arm activation assembly comprising:

a second piston housing comprising a third piston housing part and a fourth piston housing part, the fourth piston housing part being removably connected to the third piston housing part to define a second piston chamber extending in the longitudinal direction of the downhole tool, a second piston member arranged at least partly within the second piston chamber and connected with the second arm assembly, the second piston member being movable in the second piston housing in the longitudinal direction of the downhole tool, and a second through-going fluid channel in the third and fourth piston housing parts; wherein the first arm activation assembly and the second arm activation assembly are arranged in succession in the longitudinal direction so that the second end face and the third end face are abutted to provide connection between the first through-going fluid channel and the second through-going fluid channel.

2. The downhole tool according to claim 1, wherein two arm assemblies project in opposite directions from the housing.

3. The downhole tool according to claim 1, wherein, when viewed from an end of the downhole tool in the longitudinal direction, the first piston member and the second piston member each have a cross-sectional area, and wherein a transversal distribution of a cross-sectional area of the first piston member and the second piston member arranged successively overlap when viewed from an end of the downhole tool in the longitudinal direction.

4. The downhole tool according to claim 1, wherein the tool housing comprises:

a first tool housing part, and an activation unit removably connected with the first tool housing part, the activation unit comprising:

a second tool housing part, and a closing member removably connected with the second tool housing part, wherein the second tool housing part and the closing member together constitute a fluid-tight chamber wherein the first arm activation assembly and the second arm activation assembly are arranged.

5. The downhole tool according to claim 1, wherein each of the first and second arm assemblies pivot about an arm rotation axis, the arm rotation axis being offset from a centre axis of the downhole tool and being perpendicular to a plane comprising the centre axis.

6. The downhole tool according to claim 5, wherein the arm rotation axes of two successive arm assemblies are offset in opposite directions in relation to the centre axis of the downhole tool.

7. The downhole tool according to claim 1, wherein each of the arm assemblies comprises a wheel or an anchor device or a casing penetration means or a centraliser.

8. The downhole tool according to claim 1, wherein the first arm activation assembly or the second arm activation assembly comprises a crank connecting the respective piston member with the respective arm assembly.

9. A downhole system comprising the downhole tool according to claim 1 and an operational tool connected with the downhole tool for being moved forward in a well or borehole.

10. The downhole system according to claim 9, wherein the operational tool is a stroker tool, a key tool, a milling tool, a drilling tool or, a logging tool.

11. The downhole tool according to claim 1, wherein the first arm activation assembly comprises a first spring member arranged in the first piston housing, the first spring member acting on the first piston member to push the first piston member in a first direction, and the second arm activation assembly comprises a second spring member arranged in the second piston housing, the second spring member acting on the second piston member to push the second piston member in the first direction.

12. The downhole tool according to claim 1, wherein the first piston housing part has a first outer profile viewed in-line with the longitudinal direction and the second piston housing part has a second outer profile viewed in-line with the longitudinal direction, and the first outer profile and the second outer profile are the same and aligned along the longitudinal direction.

13. The downhole tool according to claim 12, wherein the first outer profile and the second outer profile are circular.

14. The downhole tool according to claim 1, wherein the first piston housing part has a first face abutting a second face of the second piston housing part, and one of the first face and the second face includes an opening that is part of the first piston chamber and is sized to allow the first piston member to be inserted through the opening and at least partly into the first piston chamber.

* * * * *